US006059109A

United States Patent [19]

Stein

[11] Patent Number: 6,059,109

[45] Date of Patent: May 9, 2000

[54] ARTICLE STORAGE TRAY

[75] Inventor: Harvey Stein, Annapolis, Md.

[73] Assignee: Olympia Industrial, Inc., City of Industry, Calif.

[21] Appl. No.: 09/188,138

[22] Filed: Nov. 9, 1998

[51] Int. Cl.[7] ..... B65D 85/28

[52] U.S. Cl. ..... 206/373; 206/515; 206/561; 206/506

[58] Field of Search ..... 206/372, 373, 206/515, 561, 518, 505, 506, 509, 510; 220/735, 23.83, 555, 556, 914, 575, 507

[56] References Cited

U.S. PATENT DOCUMENTS

| | | | |
|---|---|---|---|
| 3,107,027 | 10/1963 | Sheng-Chiao Hong | 220/575 |
| 3,219,226 | 11/1965 | Schroeder | 220/23.83 |
| 4,428,493 | 1/1984 | McDonough | 220/20 |
| 5,086,917 | 2/1992 | Dziersk et al. | 206/561 |
| 5,154,303 | 10/1992 | Jordan | 206/506 |
| 5,199,571 | 4/1993 | Wolff et al. | 206/518 |
| 5,419,451 | 5/1995 | Bitel, Jr. | 220/306 |
| 5,547,098 | 8/1996 | Jordan | 220/23.86 |
| 5,669,498 | 9/1997 | Fierek et al. | 206/373 |

*Primary Examiner*—Paul T. Sewell
*Assistant Examiner*—Nhan T. Lam
*Attorney, Agent, or Firm*—James E. Brunton, Esq.

[57] ABSTRACT

An organizer tray which is insertable within the upper portion of an empty container such as a five gallon bucket for use in organizing tools and like articles typically transported by craftsmen in empty buckets. The organizer tray is provided with bottom open, arcuately shaped channels which enable the tray to be emplaced over the upper rim portion of the container for easy access to the top open storage compartments. The organizer tray can conveniently be stacked onto a tray of identical design in a stable, slightly spaced configuration. For this purpose, the tray includes a radially inwardly extending protuberance which is engagable by a spacing finger provided on a superiorly mounted tray.

3 Claims, 7 Drawing Sheets

ARTICLE STORAGE TRAY

BACKGROUND OF THE INVENTION

1. Field of the Invention

The present invention relates generally to article storage devices. More particularly, the invention concerns a plurality of stackable insert trays for use in connection with empty containers such as five gallon buckets.

2. Discussion of the Prior Art

Many craftsmen use five gallon buckets for the storage and transport of numerous types of supplies and small tools. Such containers provide an inexpensive means for the transport of the tools and other articles from workplace to workplace. In similar fashion, gardeners often use empty containers such as five gallon buckets to store and transport gardening tools and supplies. While these empty containers function well to transport small articles, the articles have a tendency to intermingle proximate the bottom of the bucket making their retrieval frustrating and somewhat difficult.

The storage and transport trays of the present invention provide a simple, easy to use organizer for use in construction with the storage and transport of small tools and like articles using empty buckets such as five gallon containers. More particularly, the article storage and transport trays of the present invention, which are receivable within the empty container in a stacked relationship include circumferencially spaced apart compartments for the orderly storage and transport of tools and other small articles. The devices are stackable one upon another, either inside or outside the bucket, and each is provided with a central handle portion which enables easy handling and transport of the individual trays. Uniquely, the bottom wall of each of the storage trays is provided with a generally arcuate shaped channel which enables the article storage tray to also be emplaced over the upper rim portion of the empty container. With the article storage tray in this elevated stable position, convenient access to the various compartments of the tray is permitted so that the workmen can quickly and easily select a particular article from one of the spaced apart compartments formed in the tray.

SUMMARY OF THE INVENTION

It is an object of the present invention to provide a small article organizer tray which is insertable within an empty container such as a five gallon bucket for use in organizing tools and like articles typically transported by craftsmen in empty buckets.

Another object of the invention is to provide an organizer tray of the aforementioned character which is provided with bottom open, arcuately shaped channels which enable the tray to be emplaced over the upper rim portion of the container for easy access to the top open storage compartments.

Another object of the invention is to provide a tray as described which can conveniently be stacked onto a tray of identical design in a stable, slightly spaced configuration.

Another object of the invention is to provide a tray of the type described in the preceding paragraph which includes a radially inwardly extending protuberance which is engagable by a spacing finger provided on a superiorly mounted tray.

Another object of the invention is to provide organizer trays of the class described which are lightweight, readily moldable in a single piece easy to handle and very desirable in use.

DESCRIPTION OF THE INVENTION

Figure 1:
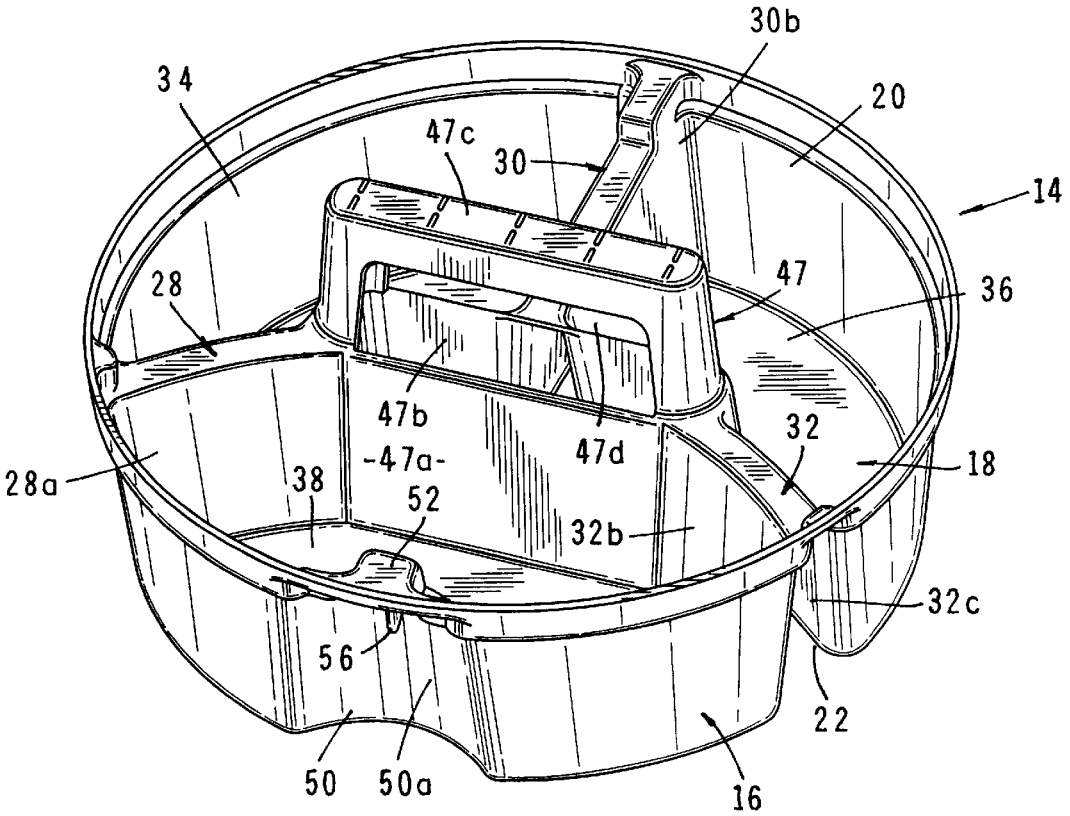
FIG. 1 is a generally perspective view of one form of the article storage tray of the present invention.

Referring to the drawings and particularly to FIGS. 1 through 6, one form of the article storage insert tray of the present invention is there illustrated and generally designated by the numeral 14. In the form of the invention illustrated, the article storage insert tray is adapted for use with a container having an interior wall which is generally circular in cross-section at any point, with the wall terminating in an upper rim portion, while the insert tray of the application can be constructed in various sizes, a primary embodiment of the invention comprises an insert tray which is sized to fit within a conventional 5 gallon container such as plastic containers used to store paint and like materials. Exemplary of such containers is the container shown in FIG. 10 and designated by the letter "C".

Figure 2:
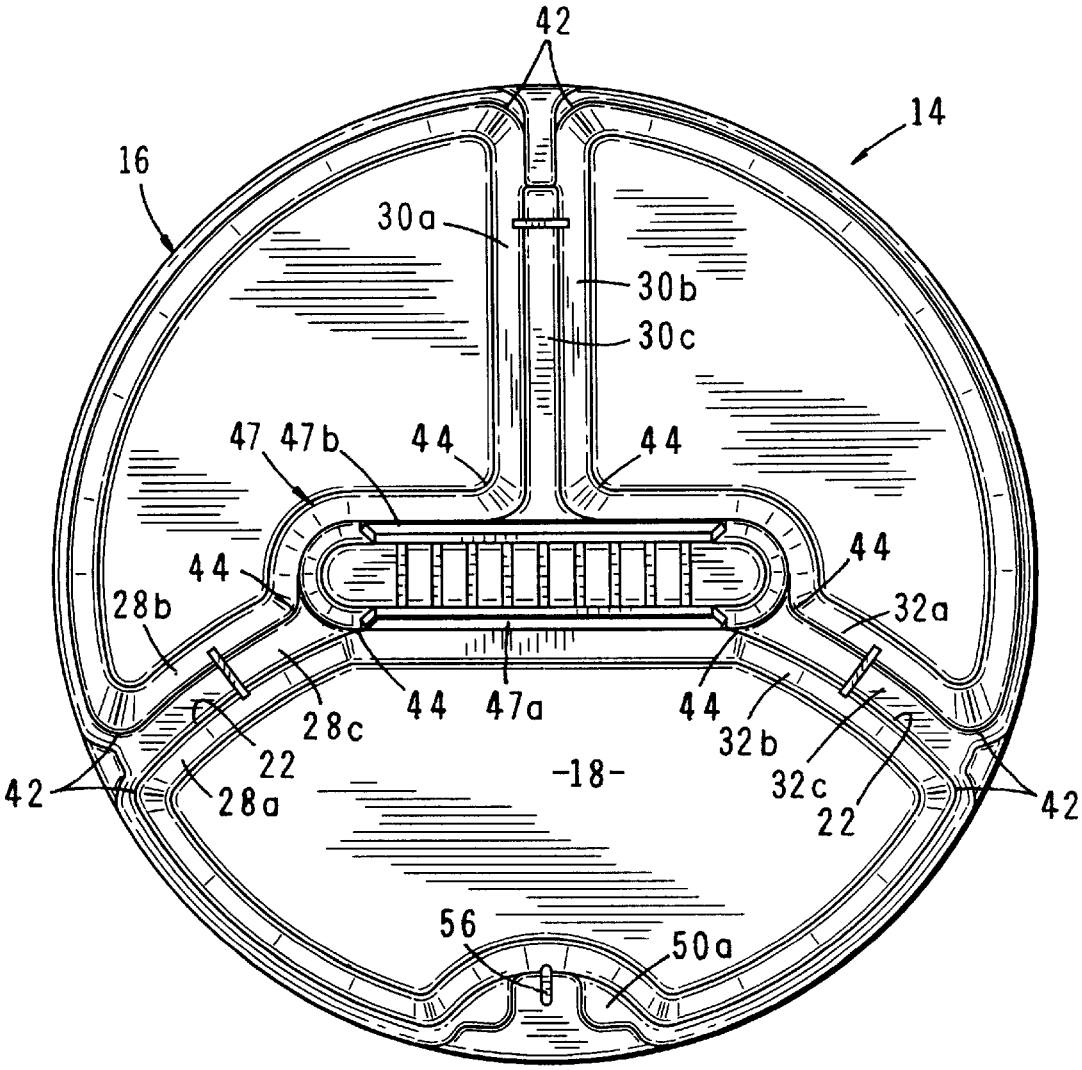
FIG. 2 is a bottom plan view of the article storage tray shown in FIG. 1.
Figure 3:
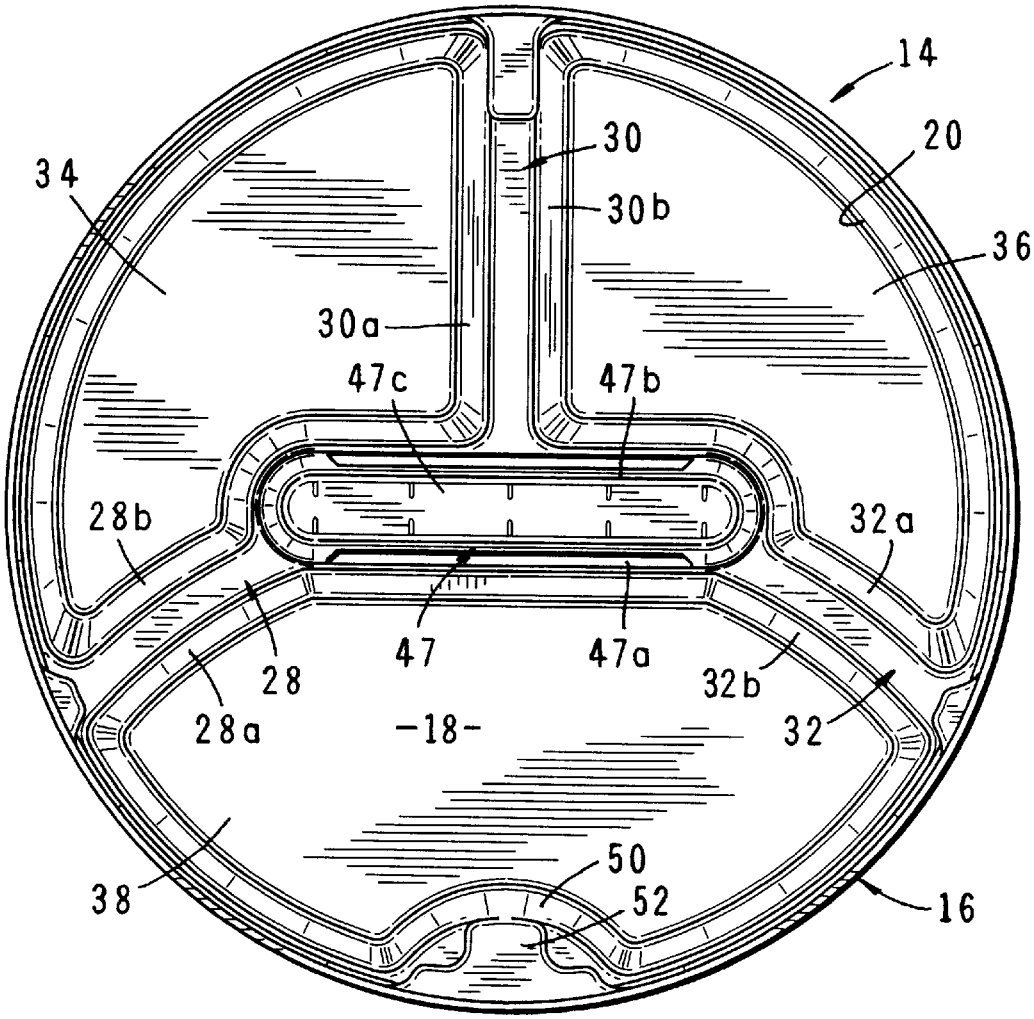
FIG. 3 is a top plan view of the article storage tray shown in FIG. 1.
Figure 4:
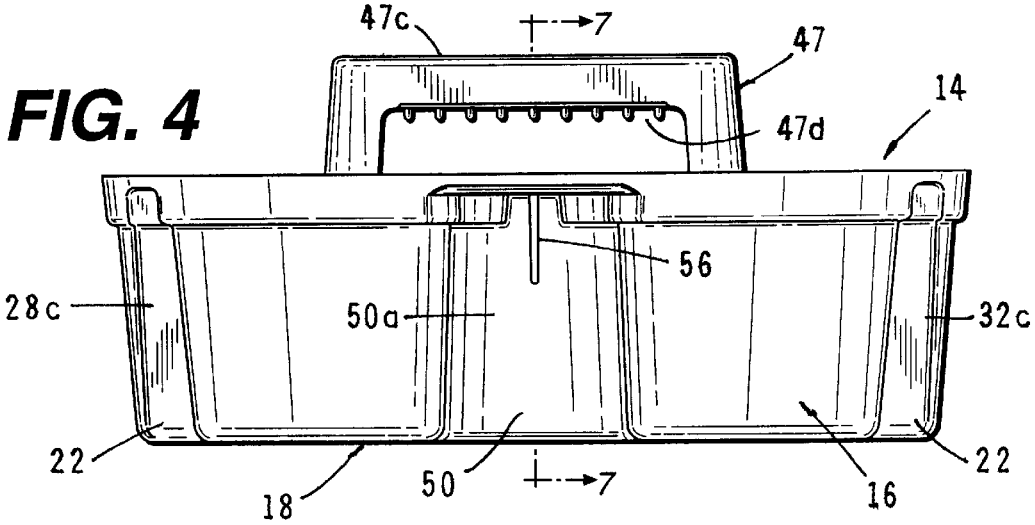
FIG. 4 is a front view of the article storage tray of the invention.
Figure 5:
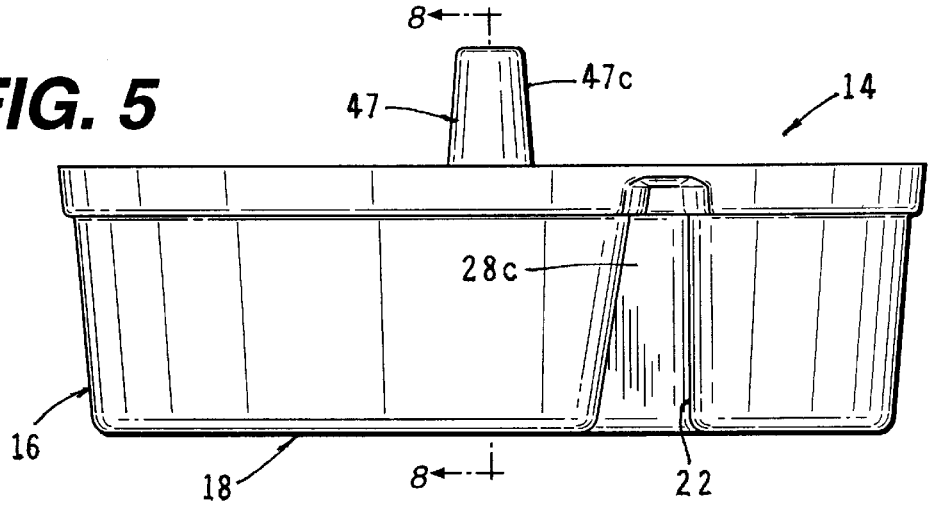
FIG. 5 is a left side elevational view of the storage tray.
Figure 6:
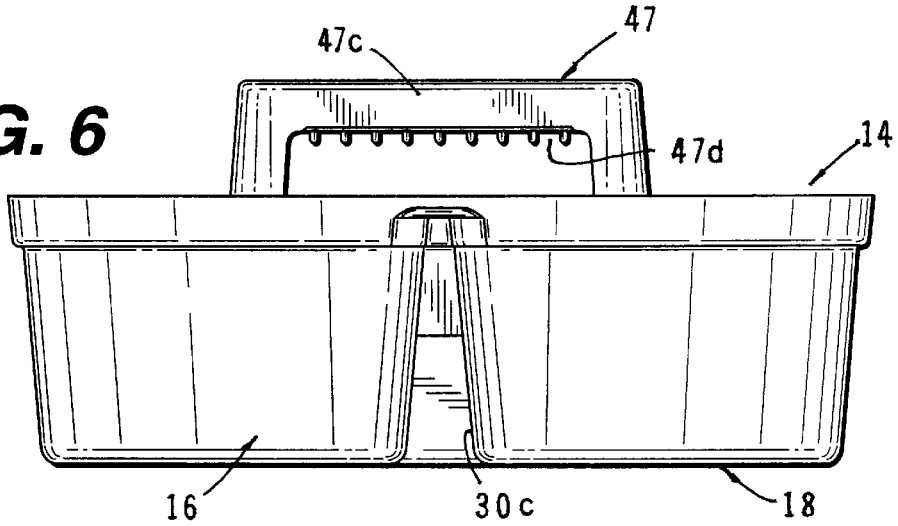
FIG. 6 is a rear view of the storage tray.
Figure 7:
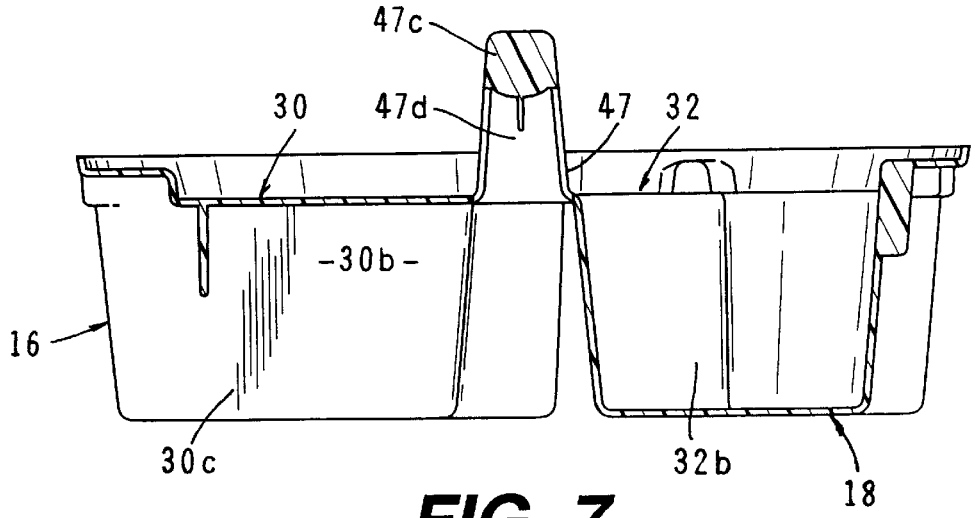
FIG. 7 is a cross sectional view taken along lines 7—7 of FIG. 4.
Figure 8:
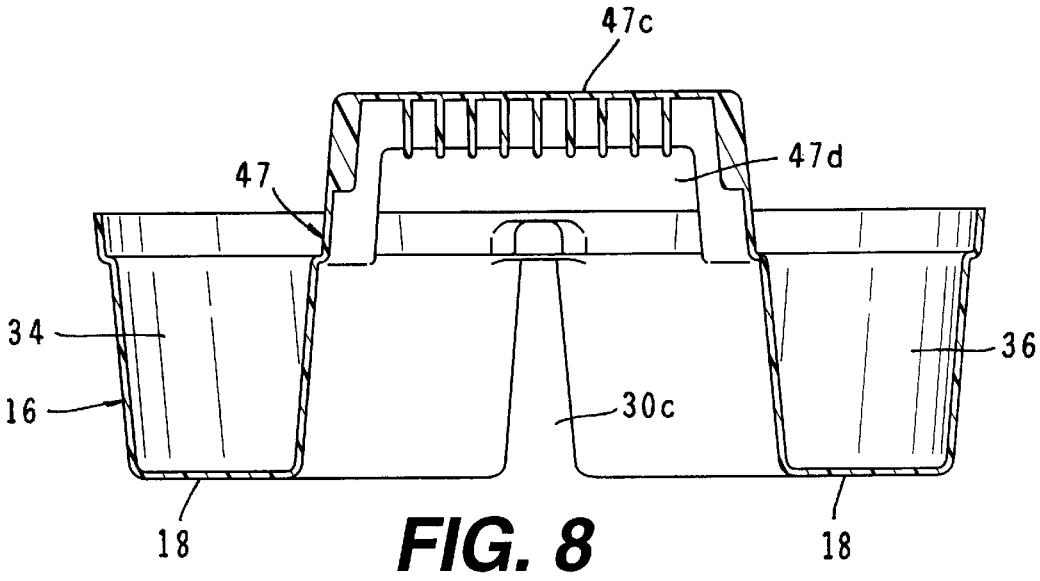
FIG. 8 is a cross sectional view taken along lines 8—8 of FIG. 5.
Figure 10:
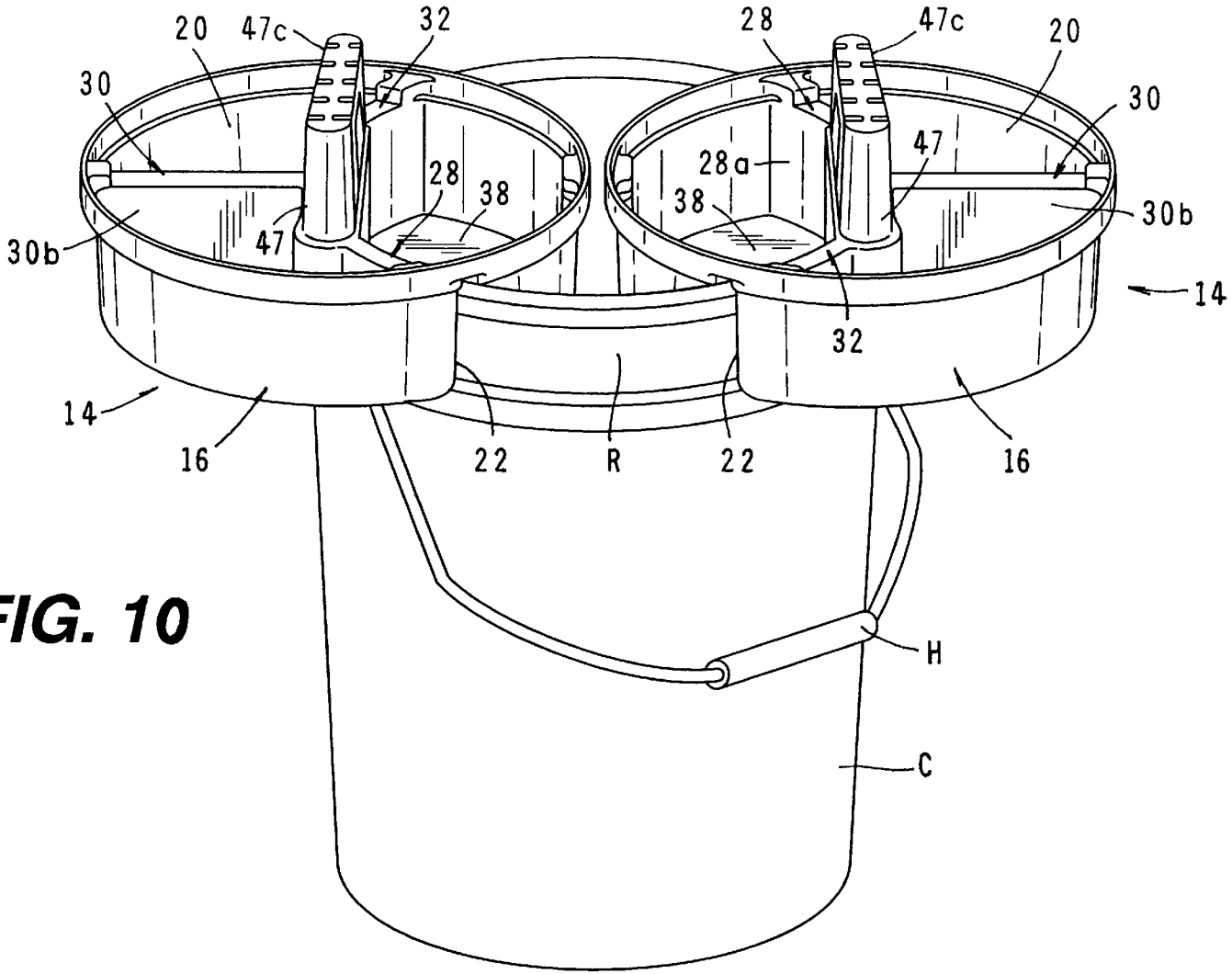
FIG. 10 is a generally perspective illustrative view showing two of the article storage trays of the present invention emplaced over the upper rim portion of an empty five gallon container of conventional design.

As best seen in FIGS. 1, 2, and 3, the article storage tray of the present embodiment comprises a tray having interconnected side and bottom walls 16 and 18, respectively, which define an interior chamber 20. Bottom wall 18 is provided with a generally arcuate shaped opening 22 which, as shown in FIG. 10, closely receives the upper rim portion "R" of container "C" (see also FIGS. 1 and 2).

As shown in FIGS. 1 and 3, three partitions 28, 30 and 32 are disposed within chamber 20 and function to divide the chamber into three circumferencially spaced apart compartments 34, 36, and 38 respectively. Partition 28 comprises spaced apart walls 28*a* and 28*b* which cooperate to define a bottom open, generally arcuate shaped channel 28*c*. Similarly, partition 30 comprises a pair of spaced apart walls 30*a* and 30*b* which function to define a generally radially extending chamber 30*c*. Partition 32 is also formed from a pair of spaced apart walls 32*a* and 32*b* which function to define a second bottom open, generally arcuate shaped channel 32*c* which interconnects with channel 28*c*. Each of the walls that make up the partitions terminate in first ends 42 which are connected to side wall 16. Similarly, each of the walls that make up the circumferencially spaced partitions terminate in a second, end 44 which is interconnected with a handle defining portion 47 which is disposed generally, centrally of internal chamber 22. Handle portion 47 includes spaced apart walls 47*a* and 47*b* and includes an upstanding gripping portion 47*c*. As best seen in FIG. 1, central handle defining portion 47 includes a finger receiving opening 47*d* for receiving the fingers of the user of the device to lift and transport the article storage tray. (See also FIG. 4)

Figure 9:
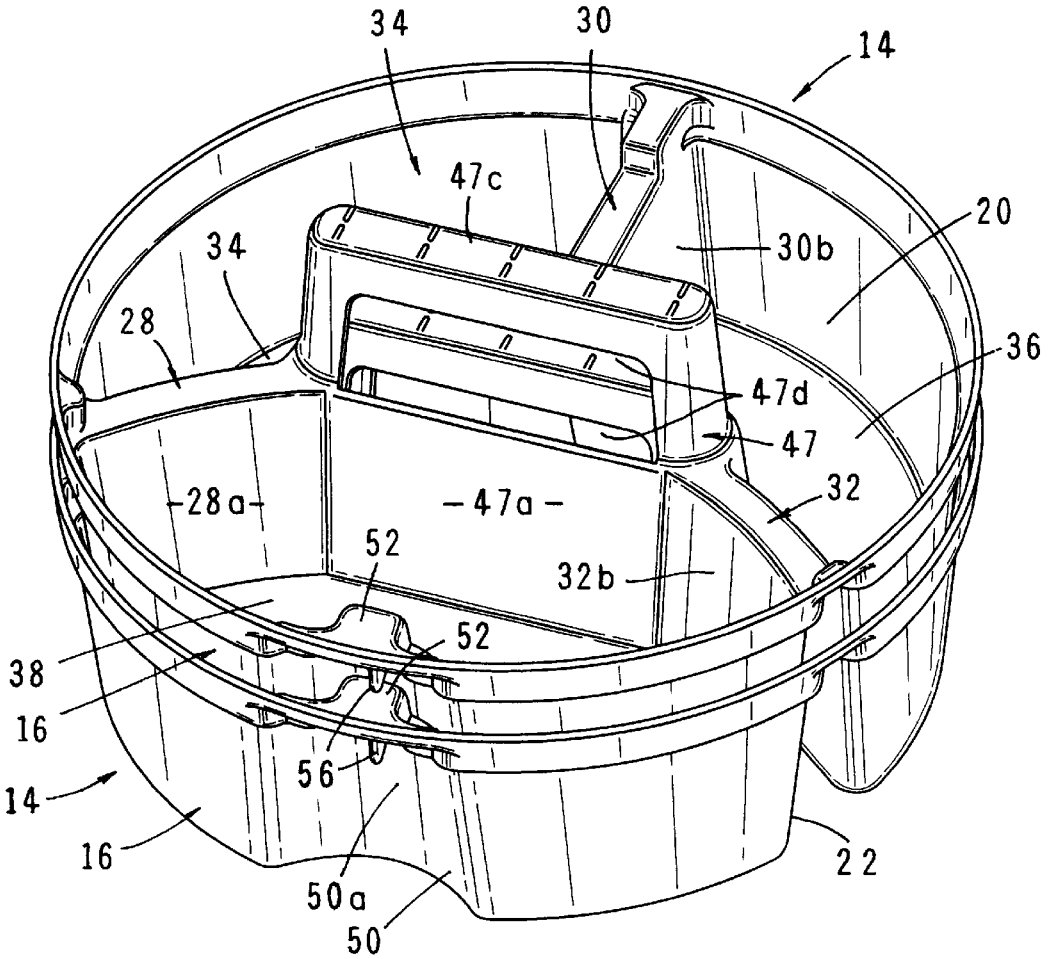
FIG. 9 is a generally perspective view of an assemblage of two of the article storage trays of the present invention.

For purposes presently to be described, side wall 16 includes a concave depression formed by an arcuate shaped, inwardly extending wall segment 50. Affixed to the upper rim portion of wall 16 and superimposed over the concave space defined by wall segment 50 is a inwardly extending protuberance 52. Extending downwardly from protuberance 52 into concave space 50*a* is a protuberance engaging finger 56. (FIGS. 1, 2, and 4) As shown in FIG. 9, when two of the article storage trays of the invention are stacked, protuberance engaging finger 56 of the superior article storage tray will depend downwardly and engage protuberance 52 of the lower article storage tray. In this way the trays are maintained in a separated configuration to enable easy removal of the superior tray from the inferior tray.

This novel stackability feature of the article trays of the present invention as described in the preceding paragraphs enables two or more trays to disposed in a stacked relationship as shown in FIG. 9. Additionally, because of the unique configuration of the trays, one or more of the article storage trays can be inserted into the container "C" so that the trays and the articles contained there within can be easily transported by lifting the handle "H" of the container "C". (FIG. 11)

As previously mentioned, if desired, the article storage trays can be removed from the interior of the container and placed over the upper rim portion "R" of the container in the manner shown in FIG. 10. When the trays are thusly positioned the workman has ready access to the circumferencially spaced apart chambers within which tools and supplies can be neatly stored and channels 23*c* and 32*c* maintain the trays in a stable generally horizontal position.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made with out departing from the scope and spirit of the invention, as set forth in the following claims.

I claim:

1. An assemblage comprising a first and second stacked article storage tray transportable by user, said assemblage being insertable into a container having an interior wall which is generally circular in cross section at any point, the wall terminating in an upper rim portion, each of said first and second storage trays comprising:

(a) interconnected side and bottom walls defining an interior chamber, said bottom wall having an arcuate shaped recess formed therein for receiving the upper rim portion of the container;

(b) at least three spaced-apart partitions dividing said inner chamber into at least three compartments, each said partition comprising first and second spaced-apart walls defining therebetween a generally arcuate shaped channel, a selected two of said partitions being disposed in alignment with said arcuate shape recess formed in said bottom wall, said first and second spaced-apart walls having first and second ends, said first ends thereof being interconnected with said side wall;

(c) a handle defining portion disposed generally centrally of said inner interior chamber, said second ends of said first and second walls of said partitions being connected to said handle defining portion, said handle defining portion including finger receiving means for receiving of the fingers of the user;

(d) an inwardly extending protuberance formed on said side wall; and (e) a downwardly extending protuberance engaging finger, said protuberance engaging finger of said first tray engaging said protuberance of said second tray.

2. An article storage insert tray for use with a container having any interior wall which is generally circular in cross-section at any point, the wall terminating in an upper rim portion, said tray comprising:

(a) interconnected side and bottom walls defining an interior chamber, said bottom wall having a generally arcuate shaped recess therein for receiving the upper rim portion of the container;

(b) a plurality of partitions dividing said inner chamber into a plurality of compartments, each said partition wall having a first end connected to said side wall of the container and a second end;

(c) a handle defining portion disposed generally centrally of said the interior chamber, said second end of said partition walls being connected to said central handle defining portion;

(d) an inwardly extending protuberance formed on said sidewall, said sidewall including an inwardly extending, generally arcuate shaped segment defining a concave space; and (e) a protuberance engaging finger extending downwardly into said concave space.

3. An article storage tray for use with a container having any interior wall which is generally circular in cross-section at any point, the wall terminating in an upper rim portion, said tray being transportable by a user and comprising:

(a) interconnected side and bottom walls defining an interior chamber, said bottom wall having an arcuate shaped recess formed therein for receiving the upper rim portion of the container;

(b) a plurality of circumferentially spaced apart partitions dividing said inner chamber into a plurality of compartments at least two of said spaced apart partitions comprising:

(i) first and second spaced apart walls defining there between a generally arcuate shaped recess for receiving the upper rim portion of the container, each of said spaced apart walls of said at least two of said partitions having a first and second ends;

(ii) a handle defining portion disposed generally centrally of said interior chamber; said first ends of said walls of said partitions being interconnected with said side wall and second ends of said walls of said partitions being connected to said handle defining portion, said handle defining portion including finger receiving means for receiving the fingers of the user; and (iii) an inwardly extending protuberance formed on said side wall, said sidewall including an inwardly extending, generally arcuate shaped segment defining a concave space, said inwardly extending protuberance being superimposed over said concave space; and (e) a protuberance engaging finger extending downwardly into said concave space.

* * * * *